US011667432B2

(12) United States Patent
Purkey et al.

(10) Patent No.: US 11,667,432 B2
(45) **Date of Patent: *Jun. 6, 2023**

(54) CONVERTIBLE SHIPPING CONTAINER AND METHOD OF DISPLAYING A PRODUCT

(71) Applicant: Sargento Foods Inc., Plymouth, WI (US)

(72) Inventors: Todd Purkey, Elkhart Lake, WI (US); Jeff Karp, Plymouth, WI (US)

(73) Assignee: Sargento Foods Inc., Plymouth, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/884,254

(22) Filed: May 27, 2020

(65) Prior Publication Data

US 2020/0283191 A1 Sep. 10, 2020

Related U.S. Application Data

(60) Division of application No. 16/021,390, filed on Jun. 28, 2018, now Pat. No. 10,683,133, which is a (Continued)

(51) Int. Cl.

| | |
|---|---|
| ***B65D 5/72*** | (2006.01) |
| ***B65D 5/02*** | (2006.01) |
| ***B65D 5/70*** | (2006.01) |
| ***B65D 5/42*** | (2006.01) |
| ***B65D 5/54*** | (2006.01) |
| ***B65D 5/32*** | (2006.01) |
| *B65B 43/10* | (2006.01) |

(52) U.S. Cl.

CPC ..... *B65D 5/725* (2013.01); *B65D 5/0227* (2013.01); *B65D 5/322* (2013.01); *B65D 5/4266* (2013.01); *B65D 5/541* (2013.01); *B65D 5/542* (2013.01); *B65D 5/701* (2013.01); *B65B 43/10* (2013.01)

(58) Field of Classification Search

CPC ..... B65D 5/725; B65D 5/322; B65D 5/4266; B65D 5/541; B65D 5/701; B65D 5/5445; B65D 2571/00574; B65B 43/10

USPC ..... 229/100, 164, 242, 103, 235, 166, 241; 206/774, 736, 746, 738, 747, 750

See application file for complete search history.

(56) References Cited

U.S. PATENT DOCUMENTS 1,925,102 A * 9/1933 Levkoff ..... B65D 5/5266 206/746

3,653,495 A 4/1972 Gray (Continued)

FOREIGN PATENT DOCUMENTS

| | | |
|---|---|---|
| EP | 670274 | 9/1995 |
| FR | 637548 | 5/1928 |

(Continued)

*Primary Examiner* — Christopher R Demeree

(74) *Attorney, Agent, or Firm* — Boyle Fredrickson, SC

(57) ABSTRACT

A shipping container includes a front wall, a rear wall positioned opposite the front wall, and first and second side walls extending between the front and rear walls. The side walls include perforations separating each of the first and second side walls into an upper portion and a lower portion. The shipping container is convertible into a display container by removal of the upper portions of the first and second side walls along the perforations.

6 Claims, 5 Drawing Sheets

Related U.S. Application Data continuation-in-part of application No. 15/663,480, filed on Jul. 28, 2017, now Pat. No. 10,683,132.

(60) Provisional application No. 62/369,598, filed on Aug. 1, 2016.

(56) References Cited

U.S. PATENT DOCUMENTS

| | | | | |
|---|---|---|---|---|
| 3,884,348 | A | 5/1975 | Ross | |
| 4,000,811 | A | 1/1977 | Hardison et al. | |
| 4,553,666 | A | 11/1985 | Gullikson | |
| 5,582,345 | A | 12/1996 | Lankhuijzen | |
| 5,657,872 | A | 8/1997 | Leftwich et al. | |
| 5,842,576 | A * | 12/1998 | Snow | B65D 5/5445 206/736 |
| 5,881,884 | A | 3/1999 | Podosek | |
| 5,887,717 | A | 3/1999 | Anderson et al. | |
| 5,927,498 | A | 7/1999 | Saam | |
| 5,979,749 | A | 11/1999 | Bosich | |
| 6,073,833 | A | 6/2000 | Desrosiers et al. | |
| 6,129,211 | A | 10/2000 | Prakken et al. | |
| 6,168,027 | B1 | 1/2001 | Esser | |
| 6,386,369 | B2 * | 5/2002 | Yuhas | B65D 5/52 206/746 |
| 6,409,077 | B1 * | 6/2002 | Telesca | B65D 5/5007 206/45.29 |
| 6,435,351 | B1 * | 8/2002 | Gibb | B65D 5/542 206/736 |
| 6,464,131 | B1 | 10/2002 | Blazevich | |
| 6,478,159 | B1 | 11/2002 | Taylor et al. | |
| 6,510,982 | B2 | 1/2003 | White et al. | |
| 6,588,594 | B2 | 7/2003 | Anderson et al. | |
| 6,729,475 | B2 | 5/2004 | Yuhas et al. | |
| 6,755,306 | B2 | 6/2004 | Maus | |
| 6,974,033 | B2 | 12/2005 | McLeod et al. | |
| 7,021,468 | B2 | 4/2006 | Cargile, Jr. | |
| 7,066,321 | B2 * | 6/2006 | Kawaguchi | B65D 5/0227 206/499 |
| 7,104,435 | B2 * | 9/2006 | Holley, Jr. | B65D 71/36 206/427 |
| 7,370,761 | B2 | 5/2008 | Anderson et al. | |
| 7,451,878 | B2 | 11/2008 | Rochefort et al. | |
| 7,604,114 | B2 | 10/2009 | Gessler | |
| 7,988,034 | B2 | 8/2011 | Pezzoli | |
| 8,342,335 | B2 | 1/2013 | Couture | |
| 8,376,141 | B2 | 2/2013 | Couture | |
| 8,430,296 | B2 | 4/2013 | Mathieu et al. | |
| 8,474,688 | B2 | 7/2013 | Cameron | |
| 8,752,708 | B2 | 6/2014 | Keefe | |
| 8,789,703 | B2 | 7/2014 | Couture et al. | |
| 9,187,207 | B2 | 11/2015 | Gessler, Jr. et al. | |
| 9,266,632 | B1 | 2/2016 | Anderson et al. | |
| 9,382,041 | B2 | 7/2016 | Couture | |
| 9,555,919 | B2 | 1/2017 | Gessler, Jr. et al. | |
| 9,738,413 | B2 | 8/2017 | Humphrey et al. | |
| 9,809,349 | B2 | 11/2017 | Gessler, Jr. et al. | |
| 10,421,580 | B2 | 9/2019 | Gessler, Jr. et al. | |
| 10,654,611 | B2 * | 5/2020 | Frost | B65D 5/4212 |
| 2003/0150747 | A1 | 8/2003 | Maus | |
| 2004/0222127 | A1 | 11/2004 | McLeod et al. | |
| 2005/0139502 | A1 | 6/2005 | Anderson et al. | |
| 2005/0184139 | A1 | 8/2005 | Gasior | |
| 2006/0006096 | A1 * | 1/2006 | Funk | B65D 5/48014 206/746 |
| 2006/0261140 | A1 | 11/2006 | Holley, Jr. | |
| 2007/0074997 | A1 | 4/2007 | Ford et al. | |
| 2010/0276333 | A1 | 11/2010 | Couture | |
| 2011/0259947 | A1 | 10/2011 | Brittain | |
| 2011/0284621 | A1 | 11/2011 | Couture | |
| 2013/0105355 | A1 | 5/2013 | Keefe | |
| 2016/0304237 | A1 | 10/2016 | Couture | |
| 2017/0021961 | A1 | 1/2017 | Humphrey et al. | |
| 2017/0174389 | A1 | 6/2017 | Keefe, Jr. | |
| 2017/0361974 | A1 | 12/2017 | Capistrant et al. | |
| 2018/0011406 | A1 | 1/2018 | Hatakeyama et al. | |
| 2018/0029747 | A1 | 2/2018 | Purkey et al. | |
| 2018/0065774 | A1 | 3/2018 | Gessler, Jr. et al. | |
| 2018/0118406 | A1 | 5/2018 | Weiss | |
| 2019/0344924 | A1 | 11/2019 | Gessler, Jr. et al. | |
| 2020/0010234 | A1 | 1/2020 | Gessler, Jr. et al. | |

FOREIGN PATENT DOCUMENTS

| | | |
|---|---|---|
| FR | 1328464 | 5/1963 |
| GB | 2115383 | 9/1983 |
| GB | 2162820 | 2/1986 |
| GB | 2233316 | 1/1991 |
| GB | 2278341 | 11/1994 |
| SE | 504791 | 4/1997 |
| WO | 98/18368 | 5/1998 |

* cited by examiner

CONVERTIBLE SHIPPING CONTAINER AND METHOD OF DISPLAYING A PRODUCT

CROSS REFERENCE TO RELATED APPLICATIONS

This application is a divisional of U.S. Non-Provisional application Ser. No. 16/021,390, filed Jun. 28, 2018, which is a continuation-in-part of U.S. Non-Provisional patent application Ser. No. 15/663,480, filed on Jul. 28, 2017, which claims priority to U.S. Provisional Patent Application No. 62/369,598, filed on Aug. 1, 2016, the contents of which are incorporated by reference herein.

BACKGROUND

The present disclosure relates to a shipping container that is convertible into a display container. For example, such containers may be used to ship a product to a retailer, be converted and then to display the product to consumers.

SUMMARY

In one construction, the disclosure provides a shipping container for shipping food packages that is convertible into a display container for displaying the food packages. The shipping container comprising 6-sided case having six walls that define therebetween a chamber and having a continuous single tear line, a first and a second wall are opposed to one another, a third and a fourth wall are opposed to one another and a fifth and a sixth wall are opposed to one another, the first, the second, the third and the fourth walls each include a portion of the tear line separating the walls into an upper portion and a lower portion, the portions of the tear line on the first and the second walls are at an angle J relative to a line parallel to the fifth wall. The shipping container further comprising food packages housed in the chamber in a single row so that each of the food packages frictionally engages at least four walls. The shipping container is convertible into a display container by removal of the upper portion of the first, the second, the third and the fourth walls. The lower portion of the third wall inhibits the food packages from falling forward out of the display case. In the display container, the food packages frictionally engage at least a portion of three of the six walls. The angle J is selected based upon the amount of air flow desired over the food packages to maintain freshness of the food therein.

In another construction, the disclosure provides a single blank foldable into a shipping container then convertible into a display container. The blank comprising a single continuous tear line; a front wall portion; a rear wall portion; first and second side wall portions; and a bottom wall portion. The tear line extends across the front wall portion, the rear wall portion and the first and the second side wall portions separating each into an upper portion and a lower portion. The tear line on the first and the second side wall portions is in a linear pattern and at an angle relative to the bottom wall portion. The blank is foldable into a 6-sided shipping container. The folded blank is convertible into a 5-sided display container by removal of the upper portions of the front wall portion, the rear wall portion and the first and the second side wall portions along the tear line.

In another construction, the disclosure provides a container having a shipping configuration for products and a display configuration for the products. The container comprising in the shipping configuration: a single tear line; a front wall including a portion of the tear line, the tear line separating the front wall into an upper and lower portion, wherein the upper portion is larger than the lower portion, and wherein the lower portion is at least 30% of the total of the front wall, and including a handle proximate the tear line for facilitating converting of the shipping configuration to the display configuration; a rear wall positioned opposite the front wall, the rear wall including a portion of the tear line, the tear line separating the rear wall into an upper portion and a lower portion and wherein the upper portion is smaller than the lower portion; a first side wall extending between the front and rear walls, the first side wall including a portion of the tear line, the tear line separating the first side wall into an upper portion and a lower portion, the portion of the tear line on the first side wall being linear and at an angle; a second side wall extending between the front and the rear walls, the second side wall including a portion of the tear line, the tear line separating the second side wall into an upper portion and a lower portion, the portion of the tear line on the second side wall being linear and at an angle; a bottom wall and products housed in the shipping configuration in a single row with each product frictionally engaging at least four of the walls. In the display configuration, the container includes: the front wall without its upper portion; the rear wall without its upper portion; the first side wall without its upper portion; the second side wall without its upper portion; the bottom wall and the products housed in the display configuration in the same orientation as the products were housed in the shipping configuration, the products frictionally engaging the lower portions of the first side wall, the second side wall and the bottom wall, and the lower portion of the front wall inhibiting the products from falling forward out of the display configuration.

Other aspects of the disclosure will become apparent by consideration of the detailed description and accompanying drawings.

DETAILED DESCRIPTION

Figure 1:
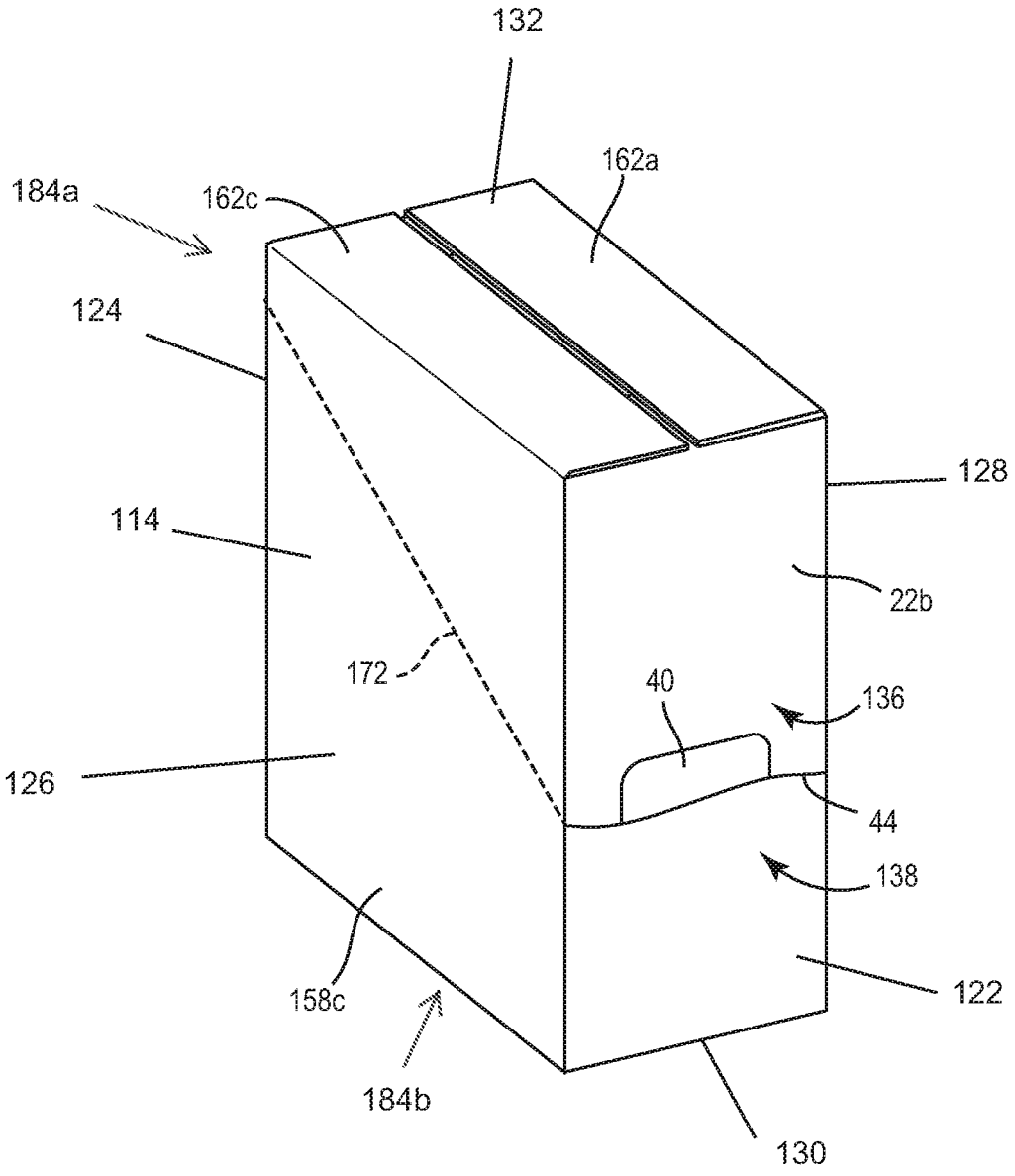
FIG. 1 is a perspective view of a case that forms a shipping container of the present invention.

FIGS. 1-5 illustrate a shipping container 110 convertible to a display container 112 in accordance with the present disclosure. The shipping container 110 includes a case 114, products 54 contained therein and optionally a tear support piece 16. In some constructions, the shipping container 110 may not include the tear support piece 16. The case 114 is formed from a blank 118 and is divisible into a tear portion 136 and a display portion 138.

Figure 2:
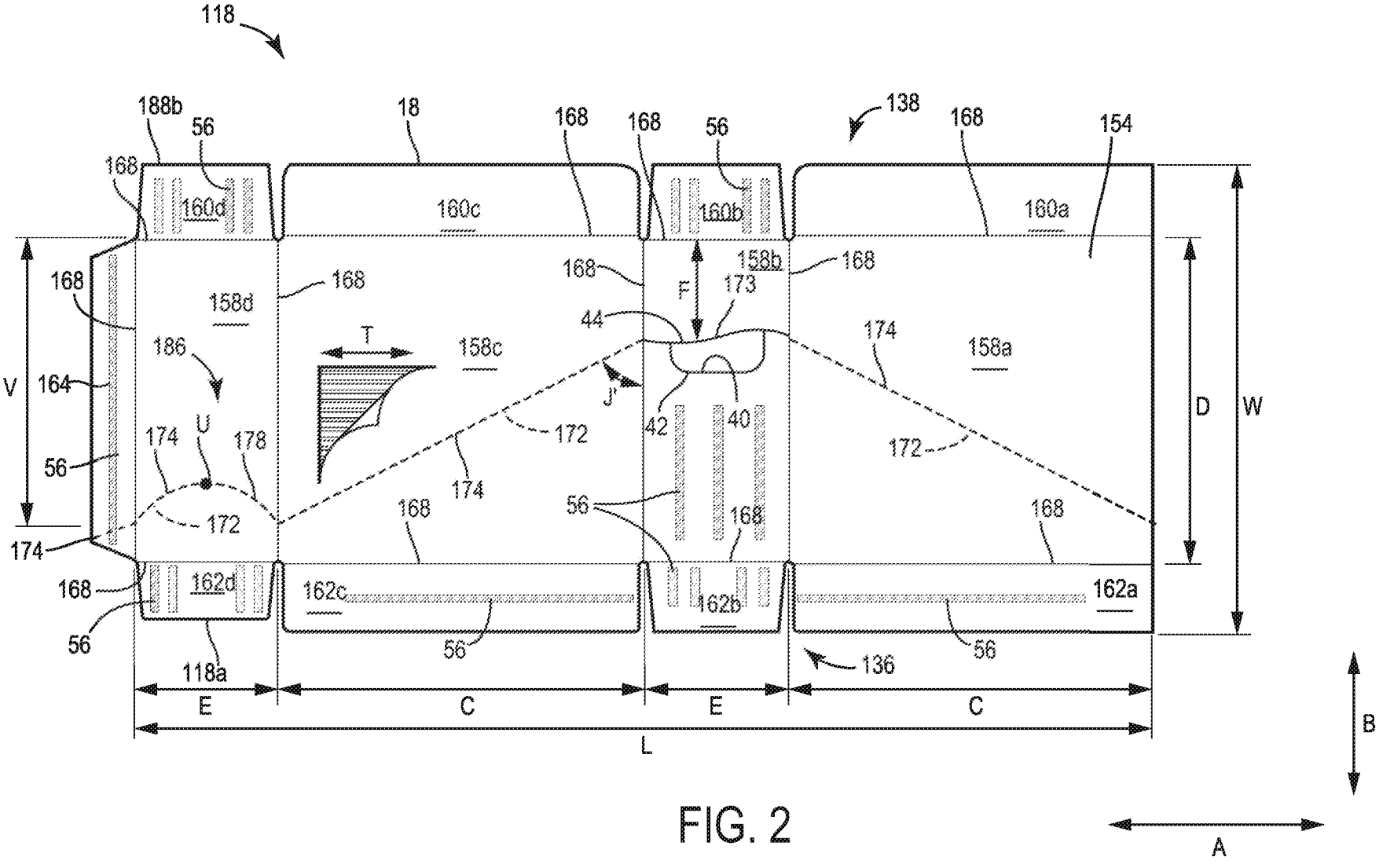
FIG. 2 is a plan view of a blank for forming the case of FIG. 1.

With reference to FIGS. 1 and 2, the case 114 includes a plurality of walls or sides defining the case 114. For purposes of description herein, a front wall 122 is defined as the side having a handle 40, and a rear wall 124 is positioned opposite the front wall 122. First and second side walls 126, 128 extend between the front and rear walls 122, 124. Bottom and top walls 130, 132 extend between the front and rear walls 122, 124. The walls 122, 124, 126, 128, 130, 132 are configured to form a three-dimensional shape defining a chamber or receptacle. In other constructions, any of the walls of the case 114 may be defined as the front, rear, sides, bottom, and/or top. The sides or walls 122, 124, 126, 128, 130, 132 are configured to enclose the chamber and contain the products 54.

With reference to FIGS. 1 and 2, the case 114 is formed from the blank 118. The blank 118 includes a generally planar main body 154 having a plurality of sections 158*a*-158*d*, lower flaps 160*a*-160*d*, upper flaps 162*a*-162*d*, and a side flap 164 defined by fold lines 168. The blank 118 is formed from a piece of material 18, and the fold lines 168 are formed as straight or curved scores, cuts, bends, creases, perforations, slits, etc., or in any other suitable manner, and in any combination, in the piece of material 18. The fold lines 168 are configured to facilitate folding, or bending, of the blank 118 along predetermined paths to form the three-dimensional shape defining the chamber. For example, the blank 118 is foldable into the case 114 along the fold lines 168, and a fastener 56 such as adhesive is used to secure the sections 158*a*-158*d*, the lower flaps 160*a*-160*d*, the upper flaps 162*a*-162*d*, and the side flap 164 of the case 114 together. Specifically, the case 114 is configured to receive product 54 into the chamber through an open end before the chamber is fully enclosed by the walls 122, 124, 126, 128, 130, 132 during assembly.

Each of the sections 158*a*-158*d*, the lower flaps 160*a*-160*d*, and the upper flaps 162*a*-162*d*, are configured to form the walls 122, 124, 126, 128, 130, 132 of the case 114. The sections 158*a*, 158*b*, 158*c*, 158*d* form the first side wall 126, the front wall 122, the second side wall 128, and the rear wall 124, respectively. The lower flaps 160*a*-160*d* form the bottom wall 130, and the upper flaps 162*a*-162*d* form the top wall 132. The glue 56 may be applied to portions of some or all of the sections 158*a*-158*d*, the lower flaps 160*a*-160*d*, the upper flaps 162*a*-162*d*, and the side flap 164 for forming the case 114.

The blank 118 includes tear lines 172 formed as linear scores, cuts, bends, creases, perforations, slits, etc., or in any other suitable manner, and in any combination, in or through the piece of material 18. The tear lines 172 generally divide the blank 118 into the tear portion 136 and the display portion 138, which will be described in greater detail below. The tear lines 172 are configured to facilitate division, separation, removal, and/or detachment of the tear portion 136 from the display portion 138 such that the tear portion 136 is removable, preferably cleanly and predictably along the along tear lines 172 while reducing unpredictable tears. In the constructions of the blank 118, the tear lines 172 extend fully across the first section 158*a*, the second section 158*b*, the third section 158*c*, the fourth section 158*d*, and the side flap 164. The tear lines 172 may extend from the fourth elongated side 42 of the handle 40 on the front wall 122.

The tear lines 172 may include pre-cut portions and perforations. As shown in FIG. 2, the tear line through second section 158*b* includes a precut 173 and the tear line through the remainder of the sections includes a perforation pattern 174 defined by a cut area by un-cut area. The perforation pattern 174 may be adjustable in which a length of the cut area by a length of the un-cut area is determined based on a weight of the product 54 and the location of the perforation pattern 174 on the case 114 (e.g., proximate edges, corners, etc. of the case 114). For example, the perforation pattern 174 may be ⅜ in. cut by ⅛ in. un-cut, ⅛ in. cut by ⅛ in. un-cut, etc. The perforation pattern 174 may be determined based on a predetermined compression strength of the shipping container 110.

With reference to FIG. 2, the tear lines 172 of the first and third sections 158*a*, 158*c* are linear tear lines. The tear lines 172 are angled by an angle J' of about 20 degrees to about 80 degrees, or more specifically of about 40 degrees to about 60 degrees (e.g., about 50 degrees in FIG. 2) from a reference line in the direction B (e.g., the nearest fold line 168). In the context of the angle J', the term "about" means plus or minus five degrees (e.g. angle J' is 50±5 degrees in FIG. 2).

With reference to FIG. 1, the tear lines 172 separate each of the first and second walls 126, 128 of the case 114 into an upper portion 184*a* and a lower portion 184*b*. Specifically, the lower portion 184*b* of each of the first and second side walls 126, 128 includes the portion between the tear lines 172 and the fold line 168 between the first section 158*a* and the first lower flap 160*a*, and the portion between the tear lines 172 and the fold line 168 between the third section 158*c* and the third lower flap 160*c*, respectively. The upper portion 184*a* of each of the first and second side walls 126, 128 includes the remaining portion of the first and third sections 158*a*, 158*c* (i.e., the portion between the tear lines 172 and the fold line 168 between the first section 158*a* and the first upper flap 162*a*, and the portion between the tear lines 172 and the fold line 168 between the third section 158*c* and the third upper flap 162*c*, respectively). The upper portion 184*a* is configured to be removed with the tear portion 136. Furthermore, the upper portion 184*a* is relatively small in comparison to the lower portion 184*b*.

The tear lines 172 in the fourth section 158*d* can be linear, or as shown, can be substantially curved and specifically can be defined as being in a downwardly curved pattern. Specifically, the tear lines 172 in the fourth section 158*d* have a pattern 186 having one radius of curvature 178; however, in other constructions, the tear lines 172 in the fourth section 158*d* may have the pattern 186 having any number of radii of curvature 178 or may extend linearly at an angle (not shown) from a reference line in the direction B (e.g., the nearest fold lines 168 between the sections 158*a* and 158*d*, or between the sections 158*c* and 158*d*) towards the fourth upper flap 162*d*. The tear lines 172 are curved by the radius of curvature 178 and may include a point U that has the farthest tear lines 172 from a reference line in the direction B (e.g., the nearest fold lines 168 between the sections 158*d* and the fourth upper flap 162*d*). In the illustrated construction, the radius of curvature 178 is about 2.3 in. The tear lines 172 on the fourth section 158*d* may facilitate removal of the tear portion 136 from the display portion 138.

The tear lines 172 separate the rear wall 124 of the case 114 into upper and lower portions 188*a*, 188*b*. Specifically, the lower portion 188*b* includes the portion between the tear lines 172 on the fourth section 158*d* and the fold line 168 between the fourth section 158*d* and the fourth lower flap 160*d*. The upper portion 188*a* of the rear wall 124 includes the remaining portion of the fourth section 158*d* (i.e., the portion between the tear lines 172 and the fold line 168 between the fourth section 158*d* and the fourth upper flap 162*d*). The upper portion 188*a* is configured to be removed with the tear portion 136. Furthermore, the upper portion 188*a* is relatively small in comparison to the lower portion 188*b*.

In the constructions of the blank 118, the display portion 138 generally includes all or portions of the first lower flap 160*a*, the first section 158*a* (e.g., the lower portion 184*b* of the first side wall 126), the second section 158*b*, the second lower flap 160*b*, the third section 158*c* (e.g., the lower portion 184*b* of the second side wall 128), the third lower flap 160*c*, the fourth section 158*d* (e.g., the lower portion 188*b* of the rear wall 124), the fourth lower flap 160*d*, and the side flap 164. The display portion 138 preferably includes relatively larger elongated portions of the first and third sections 158*a*, 158*c* that extend from directly adjacent the second section 158*b* to the fourth section 158*d*. For example, the tear lines 172 begin at a central location on the second section 158*b* and extend continuously outwards from (away from) the second section 158*b* to the fourth section 158*d* on both sides of the first and third sections 158*a*, 158*c*.

In the construction of the blank 118, the tear portion 136 generally includes all or portions of first upper flap 162*a*, the first section 158*a* (e.g., the upper portion 184*a* of the first side wall 126), the second section 158*b*, the second upper flap 162*b*, the third section 158*c* (e.g., the upper portion 184*a* of the second side wall 128), the third upper flap 162*c*, the fourth section 158*d* (e.g., the upper portion 188*a* of the rear wall 124), and the side flap 164, as well as the fourth upper flap 162*d*, and the fourth section 158*d* (e.g., the upper portion 188*a* of the rear wall 124). The tear portion 136 preferably includes more than half of the second section 158*b*, and less than half of the fourth section 158*d*.

Figure 3:
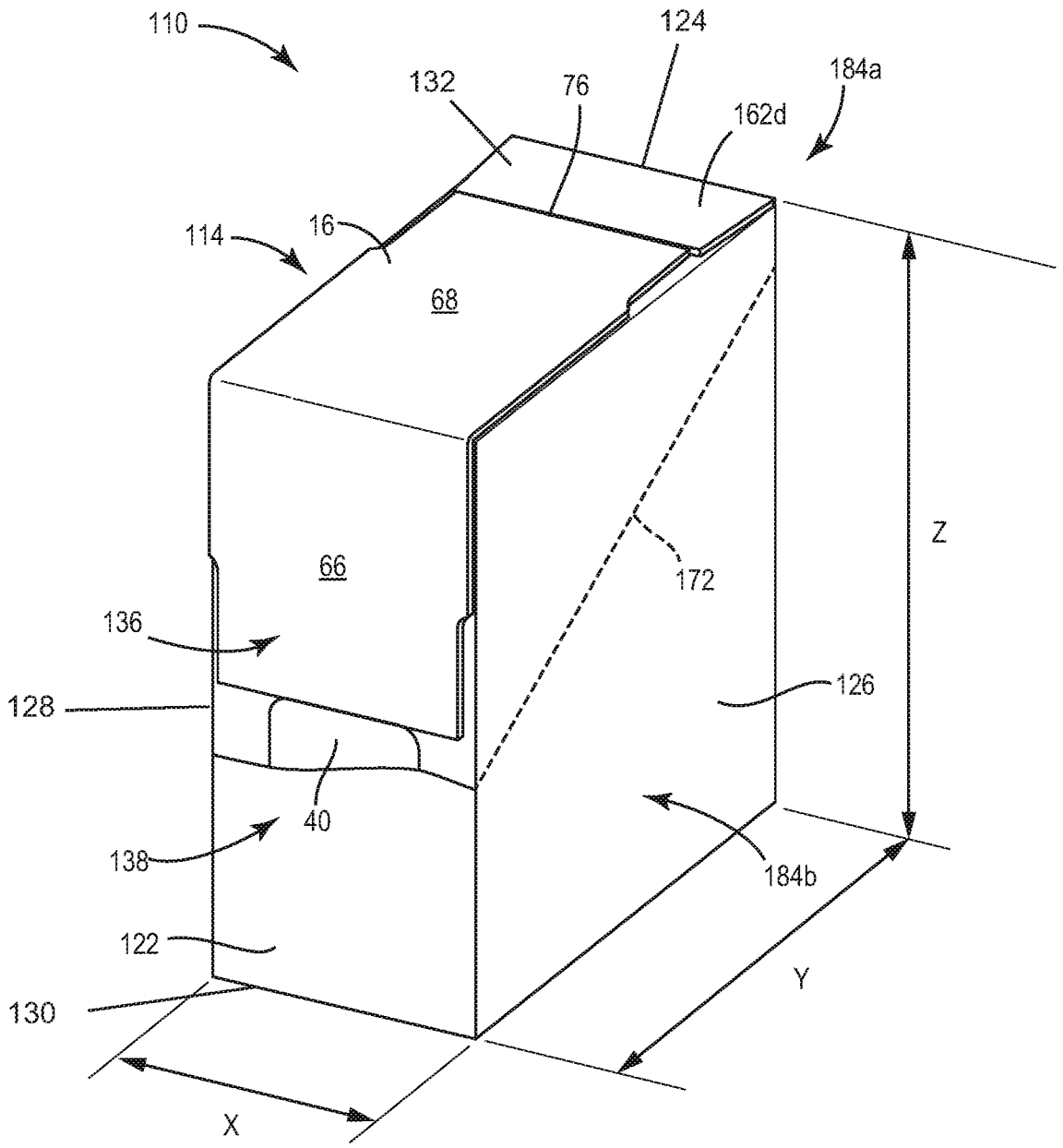
FIG. 3 is a perspective view of a tear support piece assembled with the case.
Figure 4:
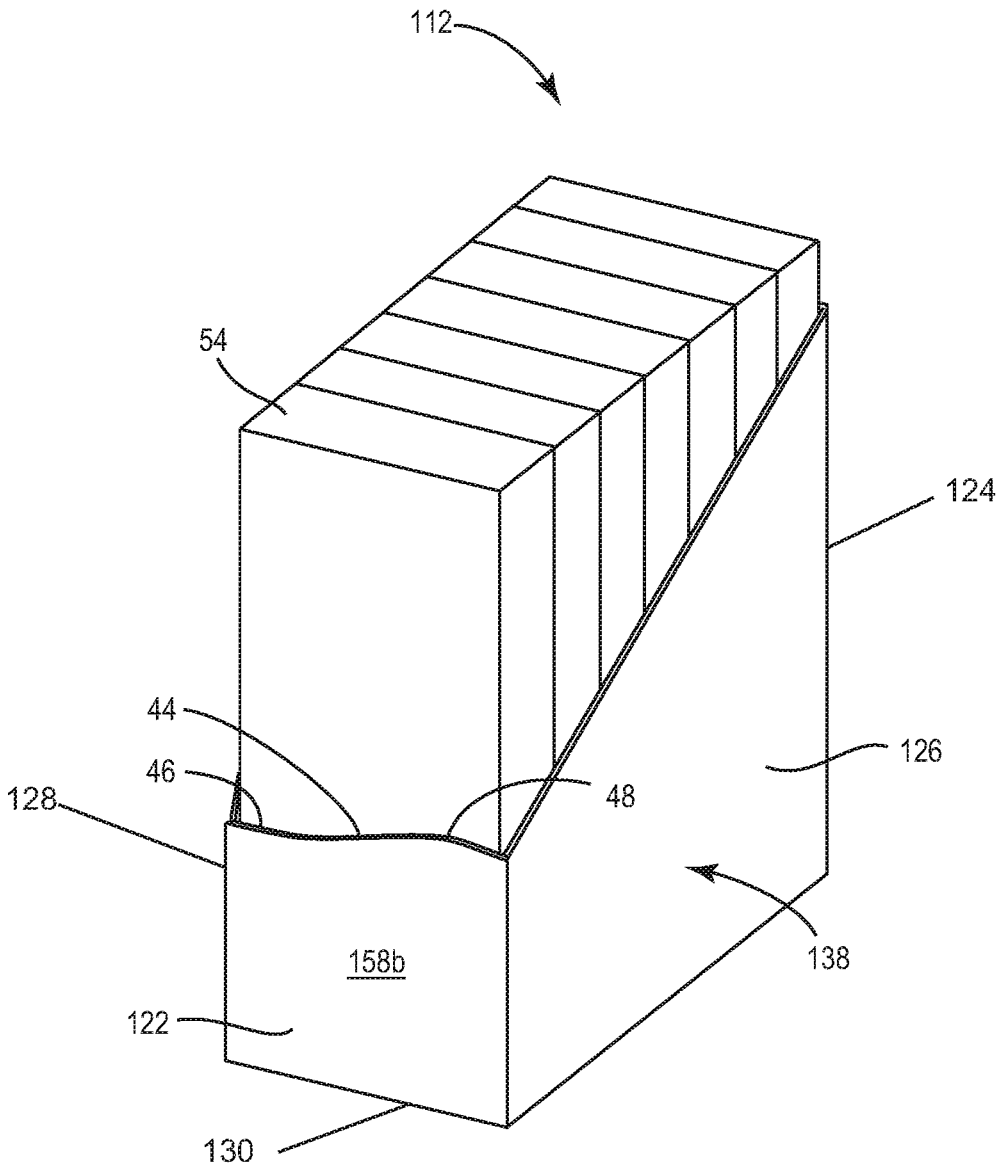
FIG. 4 is a perspective view of a display container with products displayed.

With reference to FIG. 3, the shipping container 110 is shown including the case 114 and the optional tear support piece 16. The shipping container 110 may be formed by a user coupling the tear support piece 16 to the case 114 using any type of fastening or fastener. Specifically, the user may apply adhesive such as the glue 56 to portions of the case 114 and/or the tear support piece 16 to couple the case 114 and the tear support piece 16 together. The tear support piece 16 may be disposed on one or more sides of the case 114. In the illustrated construction, the tear support piece 16 is coupable to portions of two sides (e.g., the front wall 122 and the top wall 132). In other constructions of the shipping container 110, the tear support piece 16 may not be utilized such as shown in FIG. 1. The sides of the blank 118 of completely enclose the product 54 such that the shipping container 110 may be formed when the last or sixth side (e.g., the top wall 132) is formed.

The shipping container 110 is convertible into the display container 112 by removal of the tear portion 136 from the display portion 138. In the illustrated constructions, the shipping container 110 is convertible into the display container 112 by removal of the upper portions 184*a* of the first and second side walls 126, 128 along the tear lines 172. In addition, the shipping container 110 is convertible into the display container 112 by removal of portions of the front wall 122, and the top wall 132, as well as portions of the rear wall 124. Specifically, the user inserts one or more fingers into the handle 40 and applies a pull force (e.g., in a direction generally parallel to the front wall 122) on the tear portion 136 to separate, detach, and remove the tear portion 136 and optionally the tear support piece 16 along the tear lines 172 in the removal stroke. The positioning of the tear lines 172 for the first and second side walls 126, 128 may facilitate removal of the tear portion 136 from the display portion.

Figure 5:
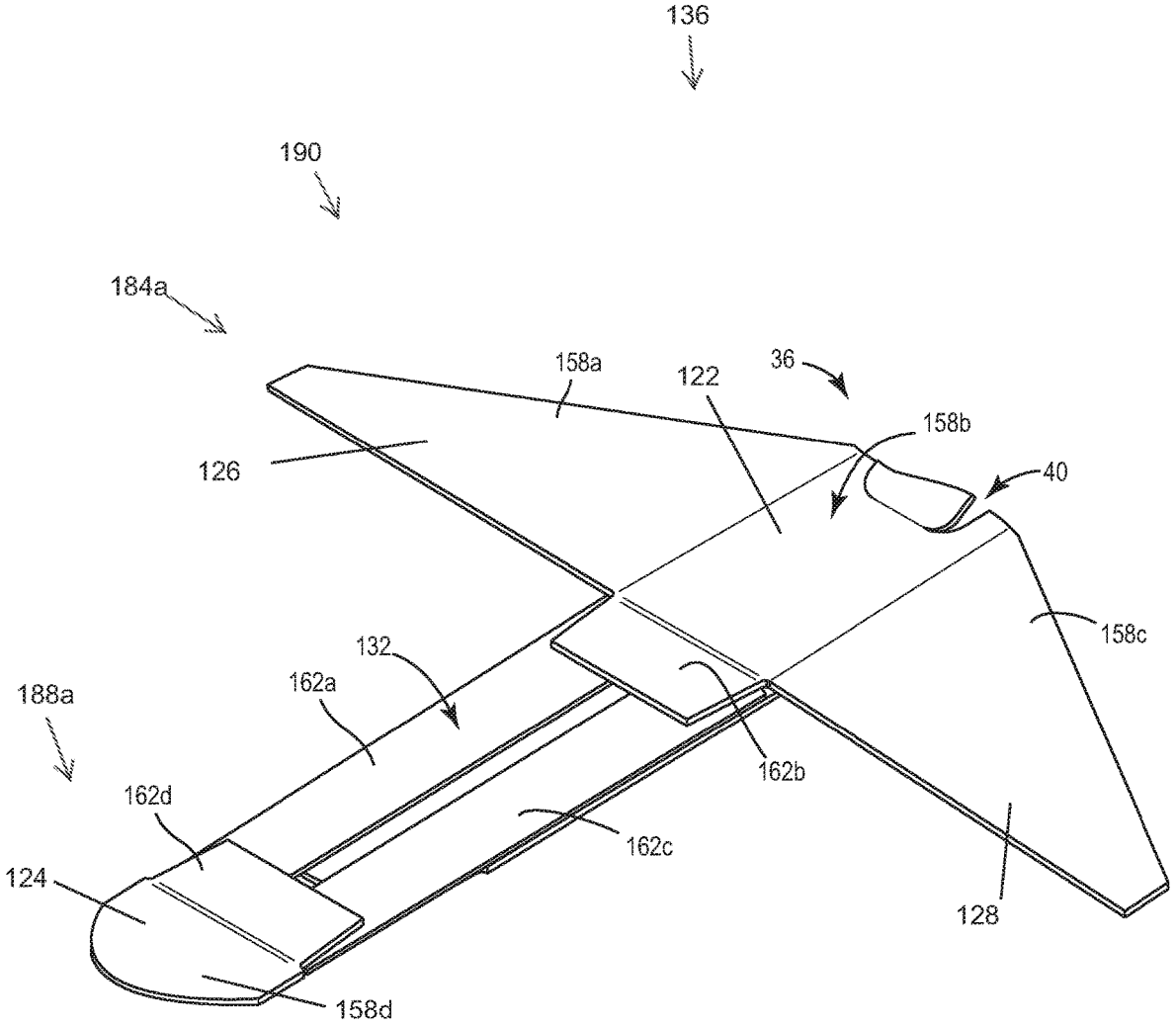
FIG. 5 is a perspective view of a tear portion and the tear support piece removed from the case.

With reference to FIG. 5, if a tear support piece 16 is included, the shipping container 110 is convertible into a display container 112 by removal as one piece 190 the tear support piece 16, the portion of the top wall 132, and the upper portions 184*a* of the first and second side walls 126, 128 along the tear lines 172. In addition, the upper portion 188*a* of the rear wall 124 is removed such that the upper portion 188*a* of the rear wall 124 may be included in the one piece 190. In other constructions of the shipping container 110, the tear support piece 16 may not be utilized such that the tear support piece 16 is not included in the one piece 190. Furthermore, the pattern 186 of the tear lines 172 for the rear wall 124 having one radius of curvature may allow the retailer or consumer to locate a shipping container 110 located behind the display container 112.

With respect to all constructions of the display container 112, the sections 158*a*, 158*c*, which provide side walls, frictionally engage the side edges of the product 54. This frictional engagement between the display container 112 and the product 54 aids in maintaining product orientation and inhibits falling forward of the product 54 when displayed.

The angle J' of the tear lines 172 for the first and second side walls 126, 128 determine how much material 18 of the first and second side walls 126, 128 are left behind on the display portion 138 when the tear portion 136 is removed. For example, if the angle J' is relatively large (e.g., about 65 degrees), less material 18 of the sections 158*a*, 158*c* remain on the display portion 138. The angle J' may be adjusted based on the dimensions of the product 54 for ensuring frictional engagement between the display container 112 and the product 54. A height of the side walls of the display container 112 may also be determined based on dimensions (e.g., height) of the product 54.

The rear wall 124 of the display container 112 is configured to frictionally engage back edges of the product 54. The rear wall 124 includes a varying height V having the point U of the blank 118 such that at least a portion of the height V of the blank 118 is less than the height D of the blank 118.

The angle J' in the first and second side walls 126, 128 (i.e., sections 158*a*, 158*c*), and the varying height V of the rear wall 124 (i.e., section 22*d*) determines the amount of support provided to the product 54 by the display container 112. Furthermore, the amount of air flow or ventilation that passes over the product 54 is adjustable by adjusting the amount of material 18 left behind on the display portion 138 when the tear portion 136 is removed. Specifically, the angle J' and the varying height V of the rear wall 124 may be determined by the proper amount of air flow that the product 54 requires. As such, the tear lines 172 in the blank 118 may be modified based on the amount of material 18 that is needed to support the product 54 in the display container 112 while optimizing air flow to the product 54. For example, the angle J' may be relatively large (e.g., about 65 degrees) such that the air flow to the product 54 increases when in the display container 112 (e.g., when the product 54 is placed on a shelf in a refrigerated merchandiser).

Various features and advantages of the invention are set forth in the following claims.

What is claimed is:

1. A shipping container convertible to a display container, the shipping container comprising:

a case formed from a blank, having six sides, having an exterior, having a tear line and divisible along the tear line into a display portion and a tear portion, the tear line extends across at least four of the sides and the tear line on two of the sides being linear and extending an angle across each side; and a tear support piece separate from the blank, separate from the tear line and secured to the exterior of the case on two of the sides of the case and adapted to provide rigidity to the tear portion for facilitating divisibility of the tear portion from the display portion;

wherein the shipping container is convertible into a display container by removal of the tear portion and the tear support piece along the tear line.

2. The shipping container of claim 1 wherein the tear support piece is secured to only two of the sides of the case.

3. The shipping container of claim 1 wherein the tear support piece is secured to the two sides of the case with only an adhesive.

4. A shipping container convertible to a display container, the shipping container comprising:

a blank folded into a case, the case generally including a plurality of sides and an exterior, the case being divisible along a single tear line into a display portion and a tear portion, at least four of the plurality of sides include the tear line, the tear line on two of the sides being linear and extending an angle across each side; and a tear support piece separate from the blank, separate from the tear line and secured to the exterior of the case at at least two of the plurality of sides of the case that are adjacent, wherein the tear support piece includes a fold line defining two sections that are generally perpendicular to each other.

5. The shipping container of claim 4 wherein the tear portion defines at least 30% of at least one but no more than two of the plurality of sides.

6. A shipping container convertible to a display container, the shipping container comprising:

a case including a plurality of sides and an exterior, the case being divisible along at least one tear line into a display portion and a tear portion, the display portion defined by at least a portion of one of the plurality of sides, the tear portion defined by at least a portion of three of the plurality of sides, the tear line extending across at least four of the sides, and the tear line on two of the sides being linear and extending an angle across each side; and a tear support piece separate from the case and separate from the tear line, secured to the exterior of the case with only a fastener and overlapping only two of the plurality of sides of the case to provide rigidity to the tear portion to facilitate divisibility of the tear portion and the display portion.

* * * * *